United States Patent [19]

Hall

[11] 3,951,246

[45] Apr. 20, 1976

[54] CIRCUIT-CLOSING DEVICE ACTUATED BY A PLURALITY OF COINS

[75] Inventor: Mitchell A. Hall, Fort Thomas, Ky.

[73] Assignee: Monarch Tool & Manufacturing Company, Covington, Ky.

[22] Filed: Feb. 27, 1974

[21] Appl. No.: 446,234

[52] U.S. Cl. ..... 194/9 R; 194/DIG. 2

[51] Int. Cl.[2] ..... G07F 5/12

[58] Field of Search..... 194/1 G, 9 R, 10, DIG. 2, 194/DIG. 15

[56] References Cited

UNITED STATES PATENTS

| | | | |
|---|---|---|---|
| 2,156,196 | 4/1939 | Romanoski | 194/DIG. 2 |
| 3,036,684 | 5/1962 | Lord | 194/9 R |
| 3,181,678 | 5/1965 | Haverstick et al. | 194/9 R |
| 3,229,797 | 1/1966 | Stackhouse | 194/1 G |
| 3,279,574 | 10/1966 | Seiden | 194/9 R |
| 3,613,855 | 10/1971 | Stackhouse et al. | 194/DIG. 2 |
| 3,791,503 | 2/1974 | Haeusser et al. | 194/9 R |

*Primary Examiner*—Robert B. Reeves
*Assistant Examiner*—Francis J. Bartuska
*Attorney, Agent, or Firm*—J. Warren Kinney, Jr.

[57] ABSTRACT

A coin-actuated circuit-closing device includes a coin chute into which a predetermined number of like coins must be inserted to initiate the closing of a normally-open electrical control circuit. The device is responsive to introduction of a predetermined number of like coins into a coin-receptive chute to close the normally-open electrical control circuit, and is operable upon closing of the control circuit to reopen same.

22 Claims, 13 Drawing Figures

CIRCUIT-CLOSING DEVICE ACTUATED BY A PLURALITY OF COINS

BACKGROUND OF THE INVENTION

The present invention relates generally to coin chutes and more particularly to coin chutes adapted to receive and accumulate a predetermined number of coins or the like to close a normally-open electrical control circuit, after which the coins are released or unloaded into a coin box or similar receptacle and the control circuit restored to its normally-open condition.

Generally, prior art coin chutes adapted to receive a fixed number of coins per single cycle of operation are not adapted to keep pace with a constantly fluctuating economy wherein changing prices often require alteration of coin-operated vending machines or the like on an almost periodic schedule. When the price of an item fluctuates, requiring modification of the coin collecting apparatus, the entire apparatus has to be completely replaced or substantially altered, often driving fluctuating profits to an undesirably low level, and even preventing automated vending of certain classes of goods. The present invention solves this problem by providing a coin chute or the like wherein the number of coins or similar tokens received by the chute is adjustable, permitting simple alteration of the collecting apparatus when required by change of item price. When a plurality of the coin chutes of the present invention are utilized in parallel systems, for example, separate, parallel coin receptive chutes for each of the coins in present common usage throughout the United States, the device may be set to receive any quantity of coins ranging in total monetary value from zero to several dollars.

Each coin receptive chute is adapted to receive a predetermined number of coins, permitting incremental variation between the upper and lower limits of a fluctuating price with ease and economy, and permitting use of the vending apparatus for ever expanding fields of endeavor without limitation due to frequent price fluctuation. The device of the present invention provides a coin chute adapted to receive and retain a certain quantity of tokens, rejecting any tokens thereafter inserted until the device is reset, presumably after the vending operation is complete. Once one less than a predetermined number of coins have been inserted in the coin receptive chute and retained thereby, the next coin inserted therein automatically closes a control circuit. The control circuit is then reset so the cycle may be repeated.

It is, therefore, a primary object of the present invention to provide a coin-token actuated circuit-closing device in association with a coin receptive chute wherein the device is adapted to close a normally-open electrical control circuit in response to receipt by the coin chute of an adjustable, predetermined number of coins or like tokens of specific size or configuration.

It is further an object of the invention to provide means for rejecting undersized coins and coins in excess of the predetermined number required to actuate the circuit-closing mechanism associated with a particular coin chute.

Other objects and features of the invention will be readily apparent from the following drawings and description.

SUMMARY OF THE INVENTION

The present invention provides a coin-actuated, circuit-closing device of the type which includes a coin chute into which a predetermined number of like coins must be inserted to close a normally-open electrical control circuit. The device includes an inclined coin slide having a coin receptive slot at the upper end thereof adapted to sequentially receive a plurality of edge-inserted like coins.

An abutment or keeper is disposed below the lower end of the slide in a position to intercept, retain and accumulate, on edge, a total of one less than the predetermined number of coins required to actuate the device.

A trip element is disposed beneath the abutment and mounted for movement from a normal, advanced, coin-intercepting position to a retracted, non-intercepting position when struck by the next coin leaving the lower end of the slide after one coin less than the predetermined number of coins required to actuate the device have been retained and accumulated on said abutment. A normally-open contact member in the control circuit is movable with the trip element to close the control circuit when the trip element is in the retracted position.

Means in association with the abutment are operable in response to closing of the control circuit to release and remove the coins accumulated therein and to simultaneously return the trip element and the coin-intercepting member to their respective normal positions.

A coin bypass is provided intermediate the upper and lower ends of the slide and the trip element includes a coin-intercepting and diverting member disposed above and adjacent the bypass for movement from a normal, non-intercepting position to an advanced, coin-intercepting position for diverting coins passing down the coin slide into the bypass when the trip element is in a retracted position.

Generally, a guide is disposed below the lower end of the slide and positioned adjacent the abutment to preclude an accidental or unintentional dislodgement of coins therefrom. Where desired, means may be provided in association with the abutment for varying the number of coins which can be there retained and accumulated.

The device of the present invention is adapted to be utilized with either one or a plurality of the described coin chutes, providing incremental flexibility in price adjustment.

DESCRIPTION OF THE PREFERRED EMBODIMENT

Figure 1:
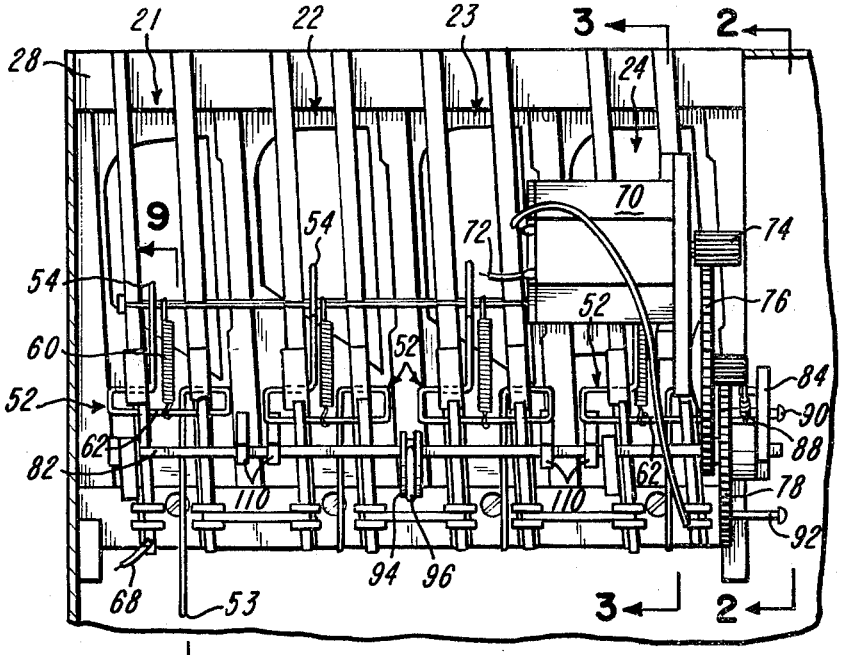
FIG. 1 is an elevation view of the adjustable, multiple coin-token actuated device of the present invention, including a plurality of coin chutes and showing in detail the various features thereof.
Figure 6:
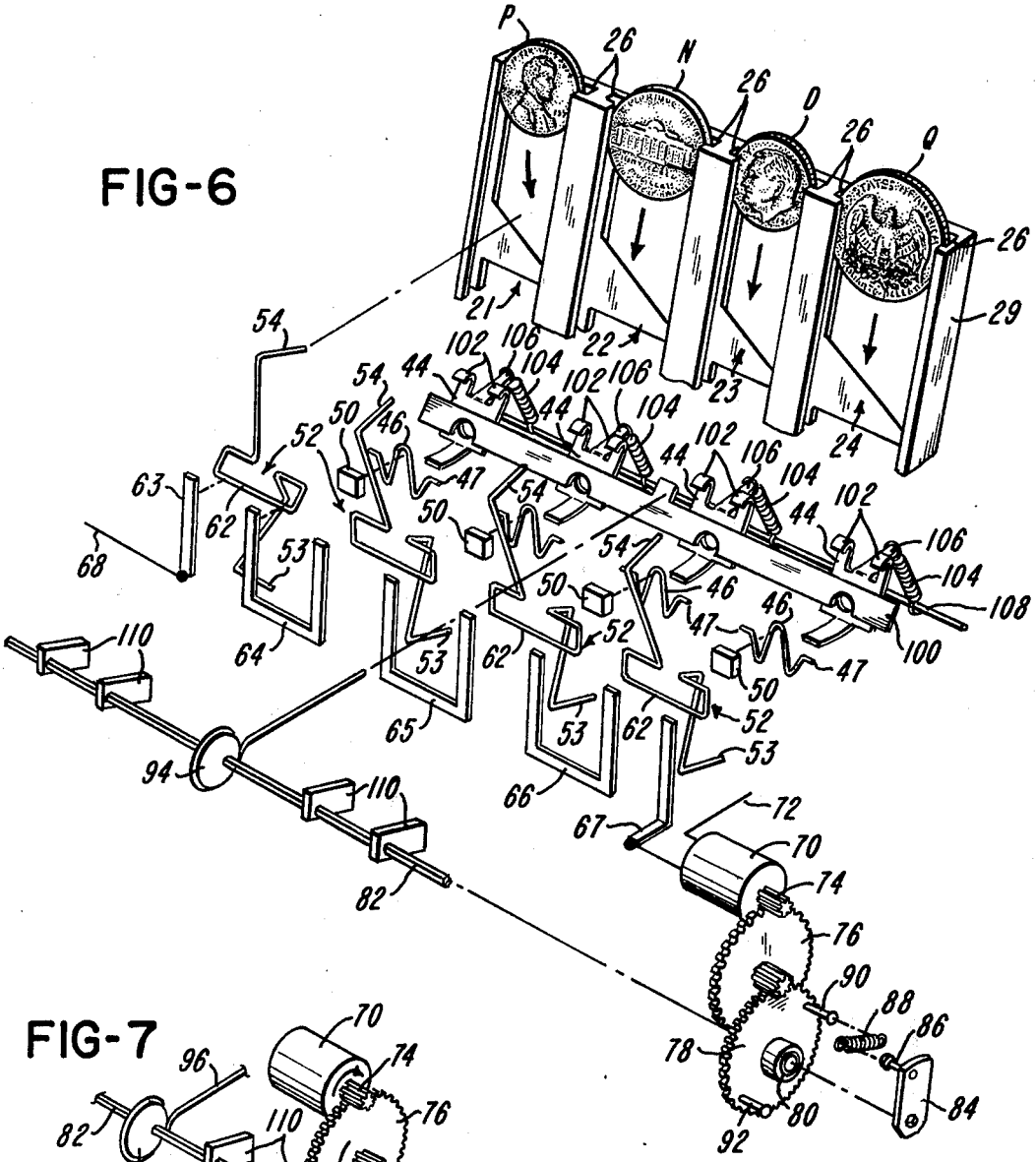
FIG. 6 is an exploded view illustrating in detail the various features of the embodiment of FIG. 1.

The various features of the device of the present invention are particularly illustrated in FIGS. 1 and 6, wherein each of a plurality of coin chutes 21, 22, 23 and 24 includes a pair of slides 26, 26 adapted to selectively receive specific coins or similar tokens P, N, D or Q. Where a plurality of coin chutes are utilized, each chute is generally constructed to receive a token of specific size or configuration, as shown in FIG. 6. It should be understood that the coin actuated device of the present invention could be limited to one coin chute or could include any number of coin chutes disposed in parallel relationship as shown, the present example utilizing four parallel coin receptive chutes, providing specific slots for each of the coins presently in common use in the United States, thereby providing incremental price adjustment from zero to several dollars without requiring alteration of the basic device.

Figure 2:
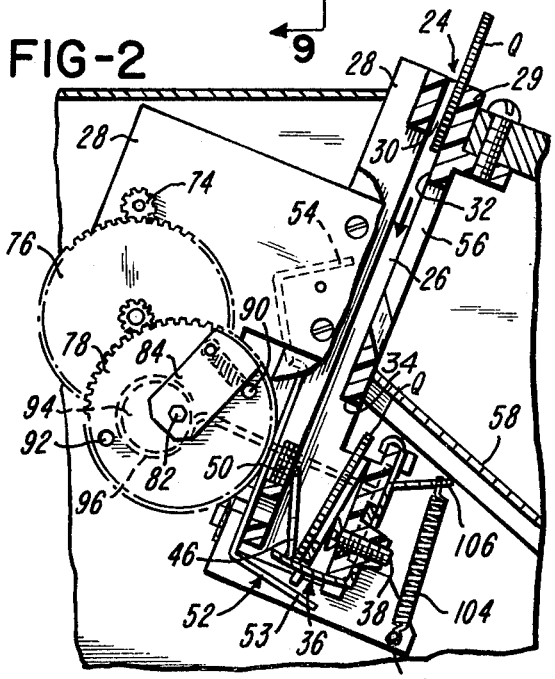
FIG. 2 is a section view taken along line 2—2 of FIG. 1.

The various coin slides 26 are generally constructed from an integral housing 29 which is fixedly secured to support member 28, providing a series of suitable slots or apertures 30 for receiving said tokens, see for example FIG. 2. As illustrated, the slides are generally inclined at a slight angle from the vertical, and tokens received through aperture 30 advance on surface 32 of slides 26 until passing lower end 34 thereof, see FIG. 3, afterwhich the tokens are accumulated at token accumulating means 36.

Figure 11:
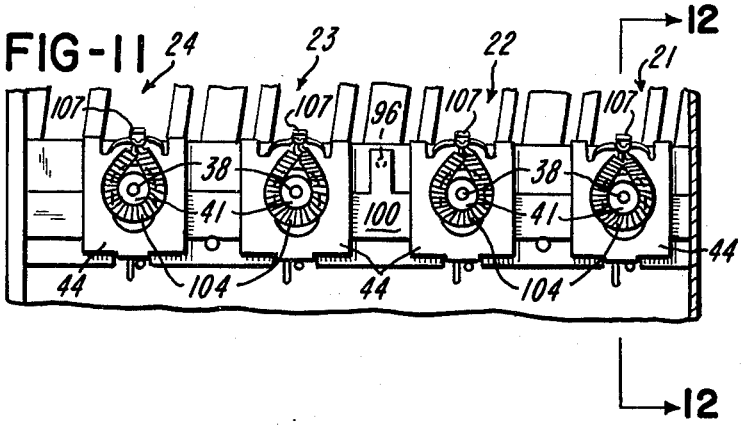
FIG. 11 is similar to FIG. 10, illustrating a modification of the token accumulating means.
Figure 12:
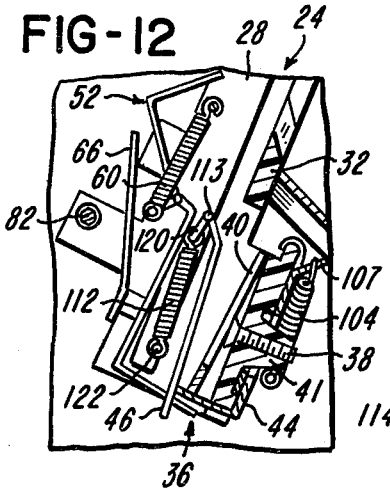
FIG. 12 is a view similar to FIG. 3, illustrating another modification of the token accumulating means.
Figure 13:
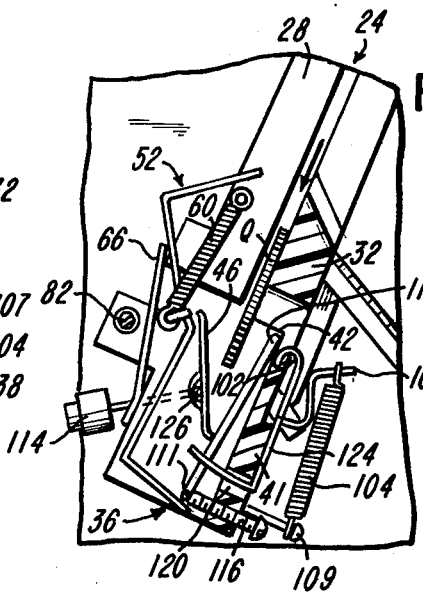
FIG. 13 is another view similar to FIG. 3, illustrating yet another modification of the token accumulating means.

The token accumulating means may be any of several embodiments, particular modifications being specifically disclosed herein and illustrated in FIGS. 11, 12 and 13. The number of tokens accumulated by means 36 is predetermined to correspond to a particular pricing structure, and is generally adjustable by providing means such as screw 38 which is axially adjustable with respect to coin chute support member 41. Swing plate 40, hinged at 42, rides on head 39 of screw 38, providing adjustment of the capacity of the accumulating means by increasing or decreasing the effective length of abutment or keeper 44, varying the number of tokens that may be there accumulated.

Figure 3:
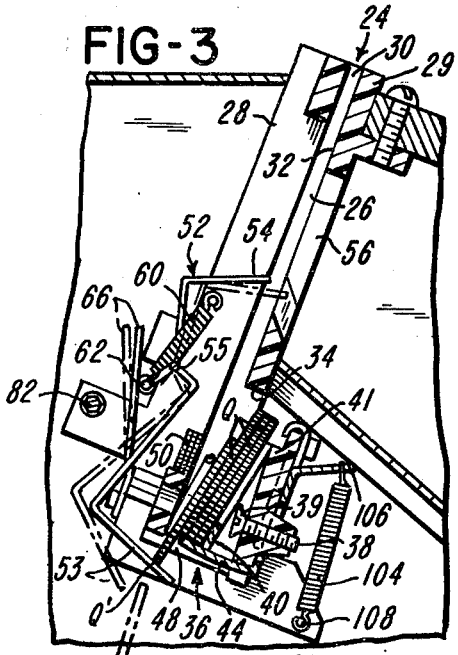
FIG. 3 is a section view taken along line 3—3 of FIG. 1.

Guide 46, pivotally mounted at 47, is resiliently urged toward keeper 44, closing opening 48 at the end thereof, ensuring that tokens received by each chute cannot accidentally be dislodged and slip therethrough prior to accumulation of the proper number. Magnet 50 provides a suitable biasing means, allowing guide 46 to be displaced by the tokens as accumulated. As shown in FIG. 3, after tokens Q are accumulated by keeper 44, token Q′ advances on slide 26, 26 to keeper 44, forces guide 46 away from the end of the keeper, and drops through opening 48.

Spring loaded trip element 52, pivotally mounted in the coin chute at 55, includes projecting fingers 53 and 54 and cross member 62. As token Q′ passes through opening 48, and is intercepted by finger 53, the weight of the falling token trips member 52, and finger 53 swings away, allowing the token to pass. This action advances finger 54 into the path provided by slots 26, 26, ensuring that tokens thereafter inserted in aperture 30 will not pass through chute 24 but will be ejected from the coin chute through bypass or return aperture 56. For example, a token advances down slide 26, 26 to the point where intercepted by finger 54, afterwhich the token is rebounded off finger 54 and ejected from the coin chute through aperture 56 to be deposited at a suitable return receptacle (not shown) via slide 58. Further, bypass 56 is adapted to divert any undersize coin which is inserted in the coin chute without respect to position of member 54.

Over-center spring 60 maintains trip element 52 in the tripped position until reset. A series of strap conductors 63–67 are coupled to one side of a suitable power source (not shown) at 68 and to one side of a drive mechanism, such as motor 70. The other side of motor 70 is secured to the other side of the power source at 72. Cross member 62 of each trip element 52 provides a normally-open contact member in the control circuit and is adapted to be advanced into contacting relationship with respective pairs of strap conductors 63–67 to close one normally-open portion of a multi-portion normally-open control circuit. When the proper number of tokens are received by each chute and element 52 is tripped, cross member 62 associated therewith is advanced into contacting relationship with a pair of strap conductors, see for example chute 24 of FIG. 3, wherein member 62 is advanced into contact with and closes the open gap between conductors 66 and 67. After chutes 21, 22, 23 and 24 each receive the respective predetermined number of tokens P, N, D or Q, member 62 associated therewith is advanced into contacting relationship with the respective pair of conductors 63–64, 64–65, 65–66 and 66–67.

Figure 4:
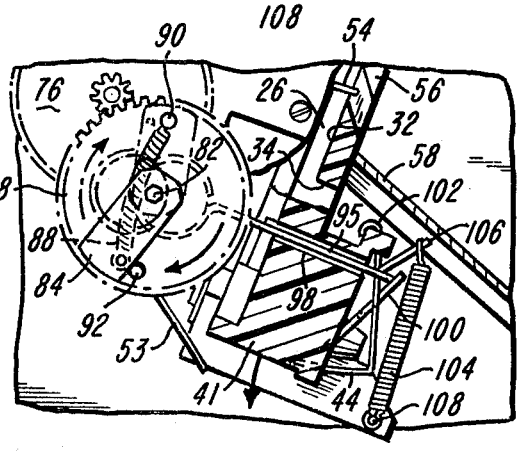
FIG. 4 is similar to FIG. 2, showing in detail the token release mechanism.
Figure 7:
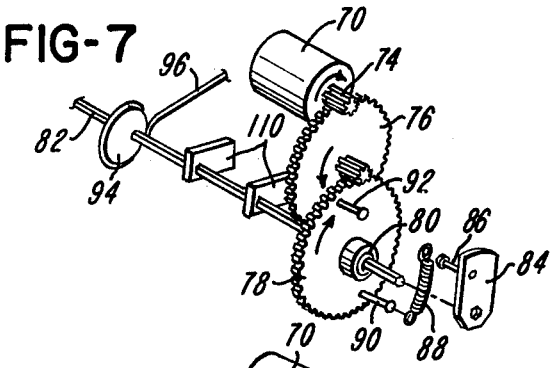
FIG. 7 is a perspective view of the token release mechanism in neutral position.
Figure 8:
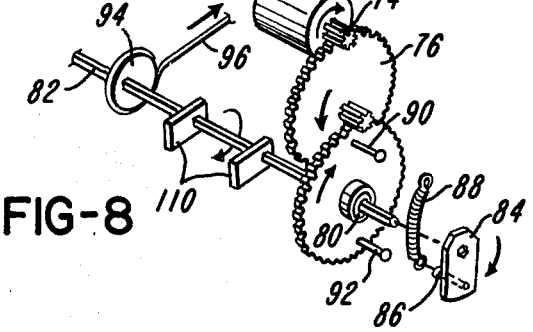
FIG. 8 is similar to FIG. 7, illustrating the token release mechanism in activated condition.

When each cross member has been advanced into contact with the various pairs of conductors the token release mechanism is activated, i.e., in the illustrated embodiment, power is supplied to motor 70, generating rotation of shaft 74 as illustrated in FIG. 7. The motor 70 is suitably mounted on support member 28, with shaft 74 in positive engagement with rotatable gear 76 which is in engagement with gear 78. Bearing 80 at the center of gear 78 provides unrestricted rotational mounting of hexagonal shaft 82. Cam 84, mounted at one end of shaft 82, includes post 86 carrying spring 88. Spring 88 is secured to post 90 which projects from gear 78. Cam 84, spring 88 and post 90 are illustrated in the home position in FIG. 2, i.e. before cross members 62 are advanced. When each cross member is advanced to close the gaps between the various conductors, drive pin 92, which is located on gear 78 at a position diametrically opposite pin 90, engages pin 86, rotating cam 84 and shaft 82 therewith, see particularly FIGS. 4 and 7. Eccentric 94, mounted on shaft 82, rotates to momentarily advance trigger 96 as shown in FIG. 8.

Figure 5:
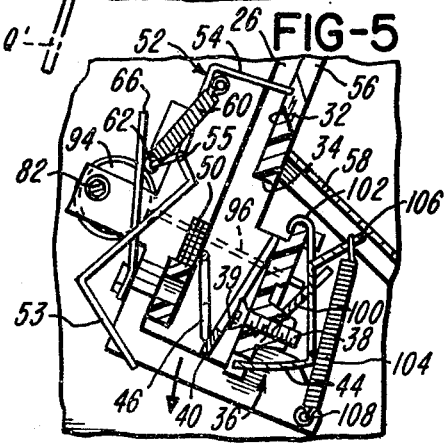
FIG. 5 is similar to FIG. 3, illustrating one coin chute at release of the accumulated tokens.
Figure 10:
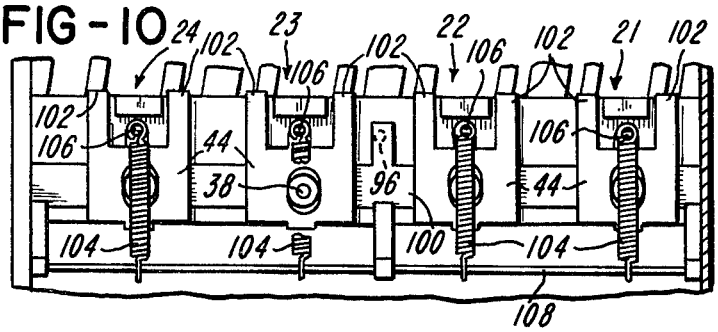
FIG. 10 is a rear view of the device including the token accumulating and release mechanisms of the embodiment of FIG. 1.

Trigger 96 extends through bore 98 in coin chute body 29, and is in positive engagement with bar 100 which is interposed between each member 41 and various keepers 44, see FIG. 10. The keepers are each hingedly mounted to members 41 at 102 and are constantly urged into the token path defined by various pairs of slots 26, 26 as illustrated in FIG. 2, by a suitable biasing device such as spring 104 which is attached to each keeper at tab 106 and to coin chute housing 29 by means of fixed rod 108. When trigger 96 is advanced as illustrated in FIG. 8, bar 100 swings out, engaging keepers 44, releasing the various tokens there accumulated, see FIG. 5. Springs 104 exert force against trigger 96, causing it to snap back, thereby rotating shaft 82 and cam 84 off-center and to home position, see FIG. 2. Keepers 44 and guides 46 are returned to their normal positions, see FIG. 3, by biasing means 50 and 104, resetting accumulating means 36 in a condition to accumulate the next series of tokens received by each of the various coin chutes.

A plurality of reset cams 110 are slidably mounted on shaft 82 and provide means for selectively resetting trip elements 52, reopening each closed portion of the multi-portion control circuit. As shaft 82 rotates as shown in FIG. 8, reset cams 110 will engage the various cross members 62, and with the aid of off-center springs 60, will trip each element 52 back to the normal position illustrated in FIG. 3, withdrawing finger 54 from the token path provided by slots 26, 26 and advancing finger 53 into the token path provided through opening 48.

Figure 9:
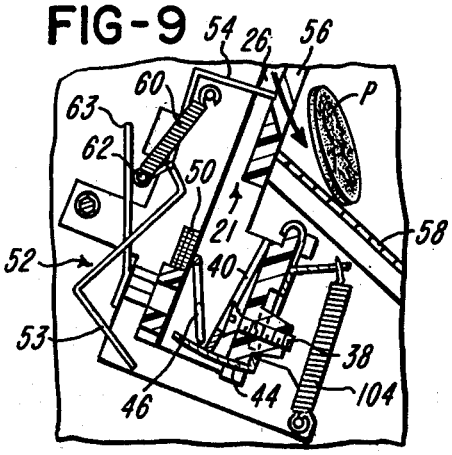
FIG. 9 illustrates one coin chute adjusted to receive zero tokens.

When desired, each cam 110 may be set to by-pass the member 62 associated therewith, thereby setting certain of the coin chutes in a condition to receive zero tokens, see particularly FIGS. 1 and 9. As illustrated in FIG. 1, cam 110 associated with member 62 of chute 21 is slidably advanced along shaft 82 to a position by-passing the cross member as the shaft rotates. Therefore, element 52 is continuously in the position illustrated in FIG. 9, finger 54 thereof intercepting any tokens received through aperture 30 and progressing along the path provided by slide 26, 26, ejecting the tokens through return bypass 56 and along slide 58 to a suitable return receptacle (not shown). Cross member 62 associated with chute 21 is maintained in continuous contacting relationship with conductors 63 and 64, see FIG. 1, and closes that portion of the circuit. Therefore, when any chute is set for zero tokens, the drive mechanism 70 is activated when the various other chutes receive the proper number of tokens as herein described.

The rear elevation of the preferred embodiment of the accumulating means 36, and the release bar 100 of the token release mechanism is illustrated in detail in FIG. 10, wherein each biasing spring 104 is connected to tab 106 of a single keeper 44 and secured to fixed rod 108, providing means urging the keepers 44 into position for accumulating tokens. A modification of the biasing scheme is provided in FIG. 11 wherein springs 104 may be looped around the extended housing for screw 38, with both ends of each spring secured to tab 107, providing suitable biasing for keepers 44.

Further modifications of the accumulating means 36 are illustrated in each of FIGS. 12 and 13, wherein biasing magnet 50 urging guide 46 toward keeper 44 is replaced by spring 112 and counterbalance 114, respectively. Guide 46 of FIG. 12 is pivotally mounted in support member 28 at 113. Spring 112 is attached to the guide at tab 120 and to the support member at 122, and serves as a biasing means constantly urging guide 46 toward keeper 44. As in the first embodiment, tokens accumulating at keeper 44 displace guide 46, and after the proper number of tokens have been accumulated, the next token received falls through the resulting opening between the guide and the keeper. After the keeper is unloaded, as herein described, spring 112 again urges guide 46 toward keeper 44.

A second modification of the retaining means 36 is illustrated in FIG. 13, wherein counter balance 114 is utilized as a biasing means constantly urging guide 46 toward adjustable swing plate 118. Guide 46 is pivotally mounted in support member 28 at 126 and is displaced by tokens accumulated in modified keeper 124, as with previous embodiments herein described. After the predetermined number of tokens have been accumulated, the last token falls through the opening created between keeper 124 and guide 46. Swing plate 118 is hingedly mounted in the coin chute at 42 and extends to end 111 of screw 110. Modified keeper 124 passes through slot 120 and through suitable clearance in plate 114, and as with the other embodiments of the invention, is hingedly mounted in the coin chute at 102. Keeper 124 includes tab 106 for carrying one end of bias spring 104, the other end of which is hingedly secured at pin 109, which is fixedly secured to the coin chute at support member 41. An added feature of the embodiment of FIG. 13 is the ability to axially adjust screw 116 from the rear rather than through the front of the coin chute, thereby changing position of swing plate 118 to vary the quantity of tokens which can be accumulated.

It should be understood that the subject device may include one or any number of individual coin chutes, each of which are provided with means for closing an electrical circuit or that leg or segment of an electrical circuit controlled by a particular coin chute, whenever a predetermined number of like coins have been introduced into said chute. The device may be used to complete an electrical circuit to any suitable type of latching, unlatching, or driving means such as, by way of example, a control for vending an item in response to insertion of a predetermined number of coins into a vending machine. It should be understood that the means for resetting the control circuit would normally be delayed until the vending operation is completed.

Further, it should be understood that the various features of the present invention could be incorporated in one or more chutes, permitting incremental adjustment of token capacity from zero to any desired quantity, providing unlimited adjustment of pricing structures.

What is claimed is:

1. A coin-actuated mechanism of the type requiring a predetermined number of coins to initiate closing of a normally open control circuit, comprising: a plurality of coin chutes each having a coin receptive slot at an upper end thereof and coin intercepting, retaining and accumulating means at a lower end thereof; a trip element associated with each chute and movable from a normal, coin-intercepting position to a non-intercepting position upon being struck by a coin passing through the chute; said coin accumulating means including means to retain and accumulate, on edge, a total of one less than a predetermined number of coins required to operate the trip element associated with the chute, whereby the next coin leaving the lower end of the chute after one coin less than the predetermined number of coins required to operate the trip element have been retained and accumulated in said coin accumulating means, is diverted past said accumulating means and strikes the trip elementt and moves it to its non-intercepting position; normally open switch means operable in response to the movement aforesaid of the trip element to close the switch means, all of the switch means of the plurality of chutes connected in series in said control circuit whereby when the predetermined number of coins required in each chute have been supplied thereto, and all of the series-connected switch means closed, closing of the control circuit is initiated; and reset means operable in response to closing of the control circuit to release all accumulated coins and to reset the trip elements to their coin-intercepting position.

2. A device as called for in claim 1, wherein a coin bypass is provided in each said chute in advance of said coin retaining and accumulating means, and wherein means are provided in said chute for diverting into said bypass all acceptable coins introduced into the chute in excess of the predetermined number of coins required to close said normally open circuit.

3. A device as called for in claim 1, which includes a bypass in each said chute in advance of said coin retaining and accumulating means, and means for diverting into said bypass undersized coins introduced into said chute.

4. A coin-actuated circuit-closing device as called for in claim 1, wherein the normally open electrical control circuit is closed only when a predetermined number of like coins have been inserted into each of said plurality of coin chutes.

5. A device as called for in claim 4, which includes means for releasably retaining and accumulating in each of said coin chutes one less than the predetermined number of like coins required to close the control circuit of each particular coin chute, and means responsive to closing the control circuits of all of said plurality of coin chutes to simultaneously release all of the retained and accumulated coins.

6. A device as called for in claim 5, wherein the passage of an acceptable coin through a coin chute with respect to which one less than the predetermined number of coins required to close the control circuit for that chute have been retained and accumulated will engage and actuate means for closing said circuit while simultaneously operating a coin deflector means for precluding the passage of other acceptable coins through said coin chute.

7. A coin-actuated circuit-closing device of the type which includes a coin chute into which a predetermined number of like coins must be inserted to close a normally-open electrical control circuit, said device comprising:

a coin chute having a coin receptive slot at an upper end thereof adapted to sequentially receive a plurality of like coins;

means at a lower end of said chute in a position to intercept, retain, and accumulate a total of one less than the predetermined number of coins required to actuate the device;

a trip element disposed beneath said means and mounted for movement from a normal, advanced, coin-intercepting position to a retracted, non-intercepting position when struck by the next coin leaving the lower end of the chute after one coin less than the predetermined number of coins required to actuate the device have been retained and accumulated by said means;

a normally-open contact member in said control circuit movable with said trip element to close the control circuit when the trip element is in retracted position;

said trip element including a coin-intercepting and diverting member disposed above said means for movement from a normal, non-intercepting position to an advanced, coin-intercepting position for diverting coins from said chute when said trip member is in a retracted position and said intercepting member is in an advanced position; and reset means in association with said coin intercepting and accumulating means operable in response to closing of the control circuit to release and remove the coins accumulated therein and to simultaneously return said trip element and said coin-intercepting member to their respective normal positions.

8. A device as called for in claim 7, including a bypass in said coin chute and means in association with said coin chute operable in response to the presence in said chute of one coin more than the retained and accumulated coins to intercept and divert any coins thereafter inserted into said bypass.

9. A device as called for in claim 7, wherein said coin intercepting and accumulating means comprises an abutment pivotally mounted beneath said coin chute in the path of coins inserted therein; and wherein said reset means is operable to pivot said abutment and release the coins there retained and accumulated.

10. A device as called for in claim 9, wherein said coin intercepting and accumulating means includes a guide pivotally mounted in said coin chute; and means urging the guide toward the abutment precluding accidental or unintentional dislodgement of coins therefrom.

11. A device as called for in claim 10, wherein said guide is of a ferro-magnetic material and said urging means is a magnet housed in said coin chute adjacent said guide.

12. A device as called for in claim 10, wherein said urging means is a spring having opposite ends secured to the coin chute and the guide, respectively.

13. A device as called for in claim 10, wherein said urging means is a counter balance mounted on the guide.

14. A coin-actuated circuit-closing device of the type which includes a plurality of coin chutes into each of which a predetermined number of like coins must be inserted to close a multi-portion normally-open control circuit, the device comprising a plurality of series-connected, normally-open contact members in said control circuit, one in association with each of said coin chutes; first means in association with each of said coin chutes to releasably retain and accumulate one less than the predetermined number of coins required to actuate the device; second means in association with each of said coin chutes operable in response to the presence in each chute of one coin more than the number of coins retained and accumulated therein to close the contact member associated therewith whereupon the normally-open control circuit is closed when all of said series-connected, normally-open contact members are closed, said means retaining and accumulating at least one coin in each of at least two chutes; means operable in response to closing the control circuit for releasing the retained and accumulated coins in each of said chutes and for simultaneously opening each of the contact members.

15. A device as called for in claim 14, including means in association with said first means for adjusting the number of coins retained and accumulated in each of said chutes.

16. A device as called for in claim 14, including a bypass in each coin chute and means in association with each coin chute operable in response to the presence in each chute of one coin more than the number of coins retained and accumulated to intercept and divert any coin thereafter inserted into said chute.

17. A device as called for in claim 14, including means in association with at least one of said coin chutes for selectively continuously closing the contact member associated therewith.

18. A device as called for in claim 17, including a bypass in said one coin chute and means in association with said one coin chute for intercepting and diverting any coins inserted therein into said bypass when said contact member is maintained in circuit-closing position.

19. A coin-actuated circuit-closing device of the type which includes a coin chute into which a predetermined number of like coins must be inserted to close a normally-open electrical control circuit, said device comprising:

an inclined coin slide having upper and lower ends;

a coin-receptive slot at the upper end of said coin slide adapted to sequentially receive a plurality of edge-inserted like coins;

a coin bypass intermediate the upper and lower ends of said slide;

an abutment disposed below the lower end of said slide in a position to intercept, retain, and accumulate, on edge, a total of one less than the predetermined number of coins required to actuate the device;

a trip element disposed beneath said abutment and mounted for movement from a normal, advanced, coin-intercepting position to a retracted, non-intercepting position when struck by the next coin leaving the lower end of the slide after one coin less than the predetermined number of coins required to actuate the device have been retained and accumulated on said abutment;

a normally-open contact member in said control circuit movable with said trip element to close the control circuit when the trip element is in retracted position;

said trip element including a coin-intercepting and diverting member disposed above and adjacent said bypass for movement from a normal, non-intercepting position to an advanced, coin-intercepting position for diverting coins passing down said coin slide into said bypass when said trip member is in a retracted position and said intercepting member is in an advanced position; and means in association with said abutment operable in response to closing of the control circuit to release and remove the coins accumulated therein and to simultaneously return said trip element and said coin-intercepting member to their respective normal positions.

20. A device as called for in claim 19, which includes a coin guide disposed below the lower end of the slide and positioned relative to said abutment whereby to preclude the accidental or unintentional dislodgment of coins from said abutment.

21. A device as called for in claim 19, which includes means in association with said abutment for varying the number of coins which can be retained and accumulated on said abutment.

22. A device as called for in claim 19, which includes an electric actuator in said control circuit, and wherein the said abutment is operatively connected to said actuator for selective movement between a normal, coin-retaining position and coin-release position.

* * * * *